US005343842A

United States Patent [19]

Fukui

[11] Patent Number: 5,343,842

[45] Date of Patent: Sep. 6, 1994

[54] CONTROL APPARATUS FOR INTERNAL COMBUSTION ENGINE

[75] Inventor: Wataru Fukui, Himeji, Japan

[73] Assignee: Mitsubishi Denki Kabushiki Kaisha, Tokyo, Japan

[21] Appl. No.: 76,141

[22] Filed: Jun. 14, 1993

[30] Foreign Application Priority Data

Jun. 17, 1992 [JP] Japan ..... 4-157654
Jun. 19, 1992 [JP] Japan ..... 4-161200

[51] Int. Cl.[5] ..... F02P 5/00; F02P 3/12
[52] U.S. Cl. ..... 123/414; 123/643
[58] Field of Search ..... 123/414, 643, 416

[56] References Cited

U.S. PATENT DOCUMENTS

| | | | |
|---|---|---|---|
| Re. 31,709 | 10/1984 | Ford | 123/416 |
| 4,681,082 | 7/1987 | Onogi et al. | 123/643 |
| 4,711,227 | 12/1987 | Li et al. | 123/643 |
| 4,979,485 | 12/1990 | Iwata et al. | 123/613 |
| 4,979,487 | 12/1990 | Fukui | 123/643 |
| 5,115,792 | 5/1992 | Fukui | 123/613 |

FOREIGN PATENT DOCUMENTS

| | | | |
|---|---|---|---|
| 3329248 | 2/1984 | Fed. Rep. of Germany | 123/414 |
| 4128909 | 3/1992 | Fed. Rep. of Germany | 123/414 |

*Primary Examiner*—Raymond A. Nelli
*Attorney, Agent, or Firm*—Sughrue, Mion, Zinn, Macpeak and Seas

[57] ABSTRACT

An apparatus for controlling operation of an internal combustion engine on the basis of a plurality of cylinder identification signals and a reference position signal includes a control means for making it possible to continue the engine operation control even when one of the above signals suffers from abnormality. The control means includes a first decision means for making decision as to whether or not the individual cylinder identification signals are normal, and a first back-up means for controlling the engine on the basis of other cylinder identification signal(s) when one of said cylinder identification signals is decided to be not normal. The control means may include in addition to the first decision means and the first back-up means a second decision means for making decision as to whether the reference signal is normal or not, and a second back-up means responsive to an output of the second first decision means indicating that the reference position signal is not normal, to thereby control operation of the engine on the basis of the cylinder identification signals.

12 Claims, 9 Drawing Sheets

CONTROL APPARATUS FOR INTERNAL COMBUSTION ENGINE

BACKGROUND OF THE INVENTION

1. Field of the Invention

The present invention generally relates to an apparatus for controlling operation of an internal combustion engine (hereinafter also referred to simply as the engine) by controlling fuel injections, ignition timings and the like for the individual cylinders of the engine On the basis of a reference position signal and/or cylinder identification signals. More particularly, the invention is concerned with an engine control apparatus which is equipped with a back-up capability or function which allows the engine operation control to be performed even when failure or fault or abnormality in more general term should occur in the cylinder identification signals or the reference position signal.

2. Description of the Related Art

In general, in the internal combustion engine for an automobile or motor vehicle, it is required to control optimally the fuel injection and the ignition timing in accordance with the operation state of the engine or motor vehicle. In conjunction with such control, a microcomputer is employed for identifying discriminatively the reference angular position of a crank shaft of the engine on a cylinder-by-cylinder basis to determine through calculation the ignition timings for the individual cylinders, respectively.

FIG. 12 is a block diagram showing an engine control apparatus known heretofore which is configured so as to perform a group-wise ignition timing control for two cylinder sets each including two cylinders in an engine having four cylinders.

Referring to the figure, there are provided as signal input means a reference position signal generating means 1 for generating a reference position signal T corresponding to a reference crank angle position on a cylinder-by-cylinder basis in synchronism with rotation of an engine (not shown) and a cylinder identification signal generating means for generating a cylinder identification signal C for identifying individual cylinders in synchronism with rotation of the engine. Each of the reference position signal generating means 1 and the cylinder identification signal generating means 2 is constituted by a rotatable slit disk mounted on a crank shaft or a cam shaft interlocked thereto and photo-detectors disposed in opposition to the rotatable slit disk, as described hereinafter in more detail.

The reference position signal T and the cylinder identification signal C are inputted to a control means 3 which can be implemented by using a microcomputer and which is adapted to detect the reference positions of the individual cylinders on the basis of the reference position signal T and the cylinder identification signal C and calculate the ignition timing or the like control parameters in accordance with the operation state of the engine to thereby output a control signal (ignition coil turn-on/off signal) for controlling the ignition timing.

An ignition coil 41 is provided in association with a set of cylinders labeled #1 and #4, while an ignition coil 42 is provided in association with another set of cylinders labeled #3 and #2. Electrical energization and deenergization of these ignition coils 41 and 42 are controlled by the control signal generated by the control means 3.

The control means 3 includes input interface units 31 and 32 for shaping (or conditioning) and fetching the reference position signal T and the cylinder identification signal C, respectively, a timing control unit 33 for calculating the ignition timings for the individual cylinders on the basis of the reference position signal T and the cylinder identification signal C in accordance with the operation state of the engine, and output interface unit 34 and 35 for outputting control signals corresponding to the ignition timings to the ignition coils 41 and 42, respectively.

FIG. 13 is a perspective view showing typical structures of the reference position signal generating means 1 and the cylinder identification signal generating means 2. Referring to the figure, a slit disk 11 which may also referred to as the signal disk is mounted on a cam shaft 10 which is rotated in synchronism with the rotation of the engine. A plurality of slits 12 and 13; 14 are formed coaxially in the signal disk 11 in the direction in which the disk 11 is rotated, wherein the radially outer slits 12 (four arcuate slits corresponding to four cylinders, respectively, and having a same length) are adapted to partake in generation of the reference position signal T for the individual cylinders, while the radially inner slits 13 and 14 of different lengths (two slits corresponding to the two cylinder sets, respectively) are adapted to generate the cylinder identification signal C for identifying the cylinder sets.

A pair of light emitter elements 15 and 17 are disposed in opposition to a pair of light receiving elements 16 and 18, respectively, wherein a peripheral portion of the disk 11 having the slits 12, 13; 14 formed therein is interposed between the light emitter elements 15; 17 and the light receiving elements 16; 18. Thus, the light emitting element 15 and the light receiving element 16 cooperate to constitute a photo-detector disposed in opposition to the trace of the slits 12 for generation of the reference position signal T, while the light emitting element 17 and the light receiving element 18 constitute a photo-detector disposed in opposition to the path of the slits 13 and 14 for generation of the cylinder identification signal C.

FIG. 14 is a timing chart which illustrates the reference position signal T and the cylinder identification signal C together with a coil current having a waveform I1 for the ignition coil 41 provided in association with one set of cylinders and a coil current having a waveform I2 for the ignition coil 42 associated with the other cylinder set. As can be seen in this figure, the reference position signal T includes pulses each having a leading edge rising up at a crank angle of B65° (indicating a crank angle 65° before the top dead center or TDC) of each cylinder and a trailing edge falling at a crank angle of B5°, wherein the position corresponding to the crank angle of B65° is referred to as the reference position with the position corresponding to the crank angle of B5° being termed the initial reference position. In terms of the crank angle, the total period of the reference position signal T for the four cylinders amounts to 720°, wherein one pulse period for each of the cylinders corresponds to 180°. Further, the pulse width or duration extending from the reference position B65° to the initial reference position B5° corresponds to 60° in terms of the crank angle, and a pulse quiescent duration intervening the initial reference position B5° for a given one cylinder and the reference position B65° for the cylinder succeeding to that given one cylinder corresponds to the crank angle of 120°.

On the other hand, the cylinder set identification signal C contains pulses of different waveforms which differ in phase from the pulses contained in the reference signal position signal T so that the signal C have a different signal level at the reference position B65° and the initial reference position B5° for the individual cylinder sets. By way of example, by imparting such waveforms to the pulses of the cylinder identification signal C that one pulse corresponding to one cylinder set assumes a signal level "1" at both the crank angle positions B65° and B5°, while the succeeding pulse corresponding to the other cylinder set assumes levels "1" and "0" at the positions B65° and B5°, respectively, it is possible to identify discriminatively the particular cylinder sets from each other. Generation of the pulses of the waveforms mentioned above can be realized by appropriately designing the slits 12 and 13; 14.

Next, description will turn to operation of the known engine control apparatus shown in FIG. 12 by reference to FIGS. 13 and 14.

When the engine rotates, the reference position signal generating means 1 constituted by the combination of the photo-elements 15 and 16 and the slits 12 and the cylinder identification signal generating means 2 constituted by the combination of the photo-elements 17 and 18 and the slits 13 and 14 generate the reference position signal T and the cylinder identification signal C which have waveforms such as illustrated in FIG. 14, respectively. These signals T and C are supplied to the timing control unit 33 incorporated in the control means 3 through the input interface units 31 and 32, respectively.

On the basis of the reference position signal T and the cylinder identification signal C, the control unit 33 detects the reference positions for the individual cylinders to thereby calculate the control quantity for controlling the ignition timing in dependence on the engine operation state, as a result of which the control signals for controlling the ignition timings are outputted from the control means 33 through the output interface 34 and 35 to be applied to the switching elements provided in association with the ignition coils 41 and 42, respectively. In that case, when the ignition timing is to advance, the timing control is performed with reference to the reference position B65°, while when the ignition timing is to lag, the timing control is then performed with reference to the second reference position B5°.

The conventional engine control apparatus described above suffers from a serious problem that when either one of the reference position signal T or the cylinder identification signal C becomes abnormal or unavailable due to occurrence of a fault or failure in either one of the two signal channels composed of the photo-detectors 15; 16 and 17; 18 and the slits 12 and 13; 14, respectively, it becomes impossible to perform the cylinder identification or the detection of the reference position, leading to functional disability or malfunction of the timing control unit 33. To say in another way, because the conventional engine control apparatus generates the engine operation control signal on the basis of the reference position signal T and the cylinder identification signal C, there may arise such unwanted situation that the engine control is rendered impossible when abnormality occurs in either one of the reference position signal (T) channel or the cylinder identification signal (C) channel. In this conjunction, it is safe to say that the possibility of simultaneous occurrence of abnormality in both the signal channels can be neglected in practical applications.

SUMMARY OF THE INVENTION

In the light of the state of the art described above, it is an object of the present invention to provide an internal combustion engine control apparatus which is capable of performing a back-up control when a failure or abnormality occurs in either one of the reference position signal channel or the cylinder identification signal channel, to thereby solve the problem which the conventional engine control apparatus suffers.

In view of the above and other objects which will become apparent as description proceeds, there is provided according to a first aspect of the present invention a control apparatus for an internal combustion engine, which apparatus comprises a plurality of cylinder identification signal generating means for generating mutually different cylinder identification signals in synchronism with rotation of the engine, and a control means for controlling the engine operation on the basis of the individual cylinder identification signals, wherein each of the cylinder identification signals is composed of a plurality of pulses which bear correspondence to the engine cylinders, respectively. The plurality of pulses are composed of a first pulse having a first pulse duration (width) corresponding to a reference position for each of the cylinders and a second pulse having a second pulse duration shorter than the first pulse duration and playing no role in determining the reference position. The above-mentioned control means incorporates internally a reference position signal generating means for generating a reference position signal corresponding to the reference position on the basis of a logical product of the individual cylinder identification signals, a decision means for making decision as to whether or not the individual cylinder identification signals are normal, and a back-up means for controlling the engine on the basis of the other cylinder identification signal when one of the cylinder identification signals is decided to be not normal by the decision means.

With the arrangement of the engine control apparatus of the structure described above in which the reference position signal is internally generated in the normal state on the basis of a logical product of the cylinder identification signal containing a plurality of pulses corresponding to the individual cylinders, respectively, the engine operation can be controlled on the basis of the cylinder identification signals and the reference position signal when the signal generating channels for the cylinder identification signals are operating normally, while upon occurrence of failure in either one of the cylinder identification signal channels, the engine operation control can be performed solely on the basis of the cylinder identification signal of the other channel.

According to a second aspect of the present invention, there is provided a control apparatus for controlling operation of an internal combustion engine which apparatus comprises a reference position signal generating means for generating a reference position signal indicating reference positions of individual cylinders of the engine in synchronism with rotation of the engine, a plurality of cylinder identification signal generating means for generating a plurality of mutually different cylinder identification signals in synchronism with rotation of the engine, and control means for controlling the engine on the basis of the reference position signal and the cylinder identification signals, wherein each of the cylinder identification signals includes a plurality of mutually complementary pulses corresponding to the individual cylinders, respectively, the plurality of pulses being composed of pulses having different pulse widths in correspondence to the reference positions, and wherein the control means includes a first decision means for making decision as to whether each of the cylinder identification signals is normal or not, a first back-up means responsive to an output of the first decision means indicating that one of the.cylinder identification signals is not normal, to thereby control operation of the engine on the basis of the other cylinder identification signal and the reference position signal, a second decision means for making decision as to whether the reference signal is normal or not, and a second back-up means responsive to an output of the second decision means indicating that the reference position signal is not normal, to thereby control operation of the engine on the basis of the cylinder identification signals.

With the above-mentioned arrangement of the engine control apparatus according to the second aspect of the invention, the engine operation can be controlled on the basis of a combination of the reference position signal and one of the cylinder identification signals when abnormality takes place in the other cylinder identification signal, while upon occurrence of failure in the reference signal channel, the engine operation control can be performed on the basis of a combination of the cylinder identification signals.

The above other objects, features and attendant advantages of the present invention will more clearly be understood by reading the following description of the preferred embodiments thereof taken, only by way of example, by reference to the drawings.

DESCRIPTION OF THE PREFERRED EMBODIMENTS

Now, the present invention will be described in detail in conjunction with the preferred or exemplary embodiments thereof by reference to the drawings.

EMBODIMENT 1

Figure 1:
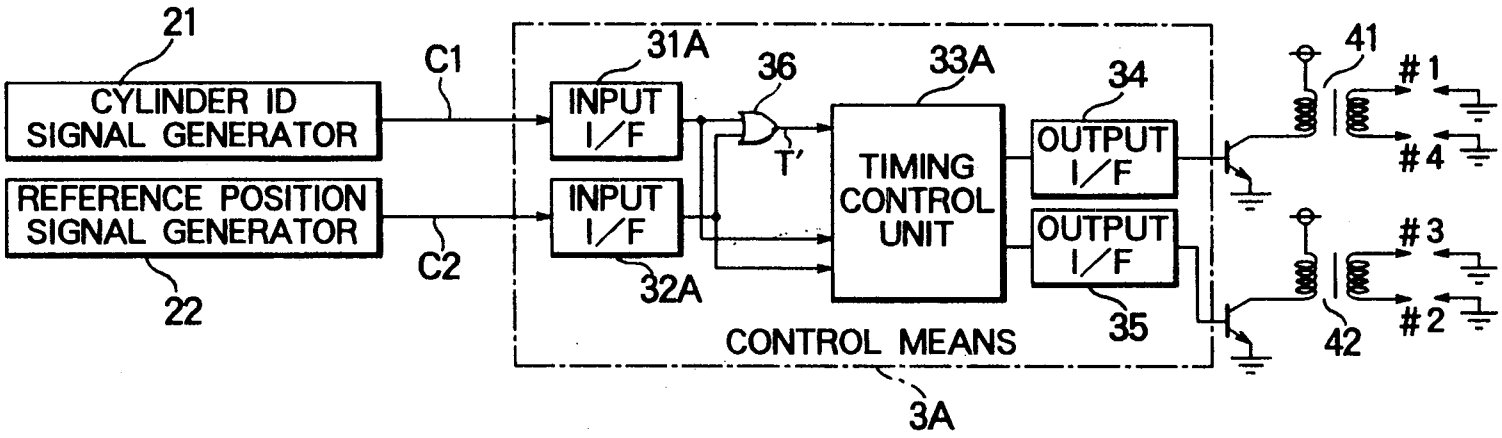
FIG. 1 is a block diagram showing a structure of an engine control apparatus according to a first embodiment of the present invention.
Figure 12:
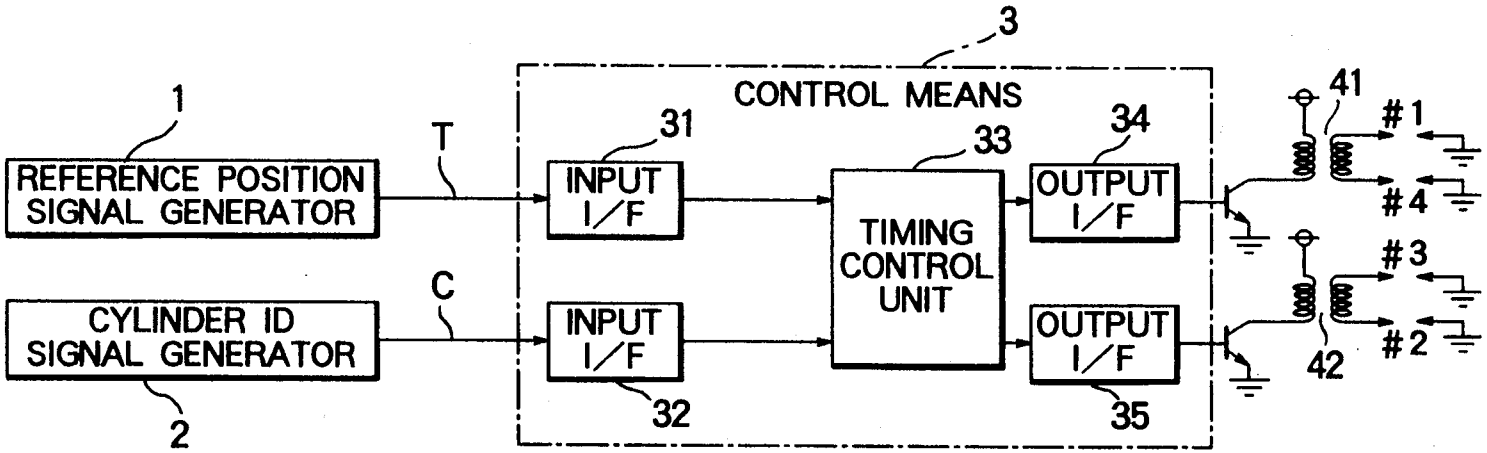
FIG. 12 is a block diagram showing schematically a structure of an engine control apparatus known heretofore.
Figure 13:
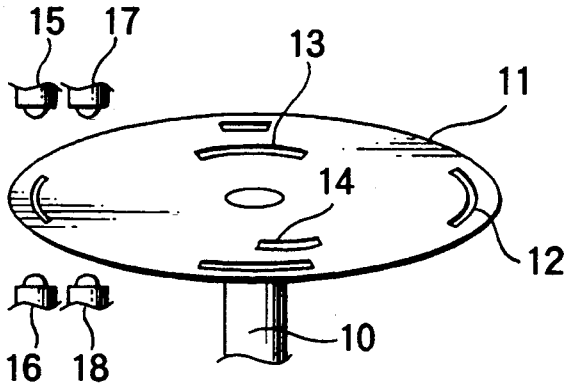
FIG. 13 is a schematic perspective view showing typical structures of a reference position signal generating means and a cylinder identification signal generating means incorporated in the conventional apparatus shown in FIG. 12.
Figure 14:
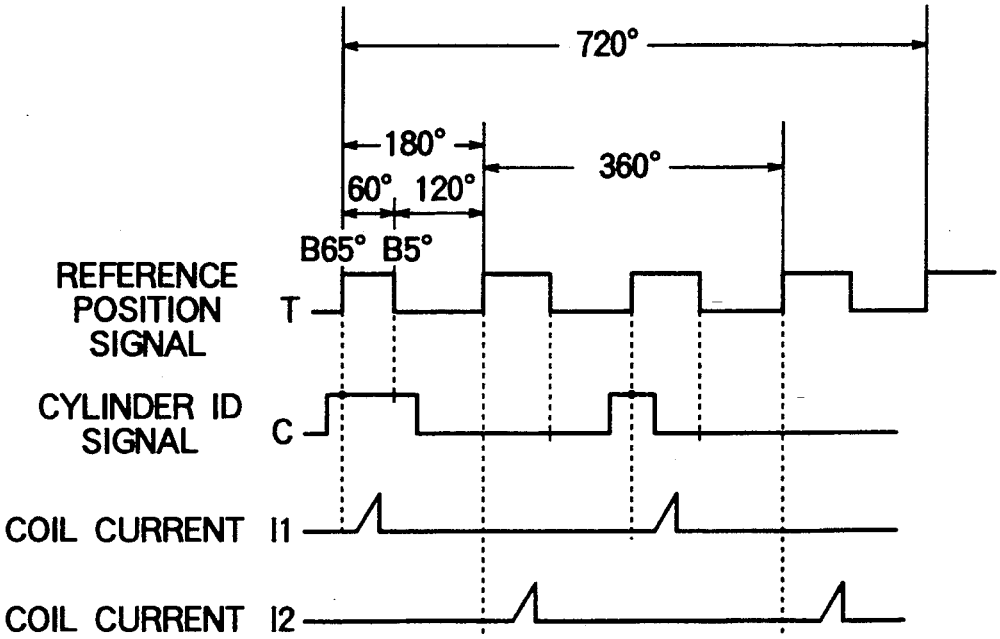
FIG. 14 is a signal waveform diagram for illustrating operation of the conventional engine control apparatus shown in FIG. 12.

FIG. 1 shows in a schematic block diagram a general arrangement of the engine control apparatus according to a first embodiment of the present invention. In this figure, reference numerals 34, 35, 41 and 42 denote same or equivalent components designated by same numerals in FIG. 12 and described hereinbefore in conjunction with the related art. Accordingly, repeated description of these components will be unnecessary. Further, a control means 3A, input interfaces 31A; 32A and a timing control unit 33A correspond to those denoted by reference numerals 3, 31; 32 and 33, respectively, in FIG. 12.

According to the teachings of the invention incarnated in the instant embodiments, there are provided a plurality of cylinder identification (ID) pulse signal generating means (more specifically, two cylinder identification pulse signal generating means 21 and 22 are provided in the case of the instant embodiments) for generating mutually different cylinder identification pulse signals C1 and C2 in synchronism with the rotation of an engine (not shown) for two sets of cylinders each consisting of two cylinders #1; #4 or #2; #3 on the assumption that the engine of concern is of a four-cylinder type. The cylinder identification pulse signals C1 and C2 are inputted to the control means 3A via the input interface units 31A and 32A, respectively. Each of the cylinder identification pulse signals C1 and C2 contains a plurality of pulse pairs in correspondence to the engine cylinder sets, respectively, wherein in each of the pulse pairs, a first or leading pulse P1 has a first pulse width or duration T1 corresponding to the reference position of the associated cylinder, while a second pulse P2 has a pulse width or duration T2 which is shorter than that of the first pulse P1 and which plays no role in determination of the reference position.

Figure 3:
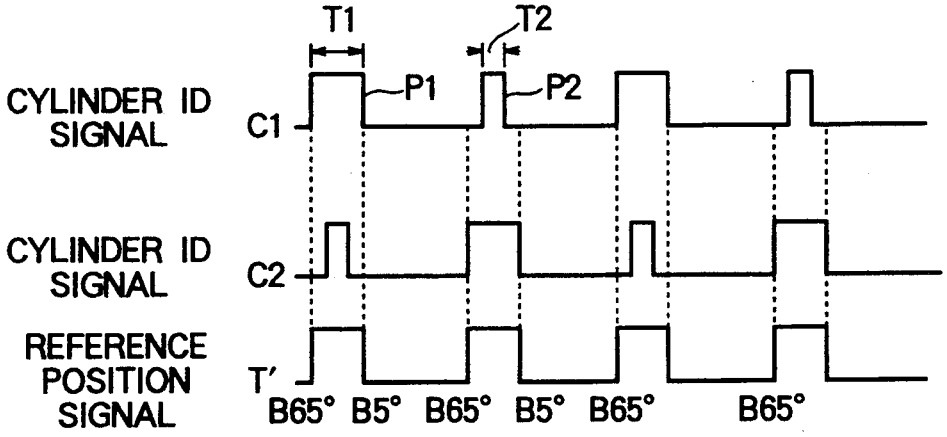
FIG. 3 is a waveform diagram showing waveforms of cylinder identification signals and a reference position signal generated and utilized in the engine control apparatus shown in FIG. 1.

An OR gate 36 is interposed between the outputs of the input interface units 31A and 32A and an input of the timing control unit 33A. This OR gate 36 constitutes an internal reference position signal generating means. More specifically, the OR gate 36 generates a reference position signal T' corresponding to the reference positions of the individual engine cylinders on the basis of a logical product signal obtained by logically ORing the cylinder identification pulse signals C1 and C2, as can be seen in FIG. 3. In this case, the timing control unit 33A performs the cylinder identification and detection of the reference positions on the basis of the cylinder identification pulse signals C1 and C2 and the reference position signal T' to thereby calculate the ignition timings for the engine cylinders, respectively. Further, the timing control unit 33A incorporates monitor/decision means for monitoring constantly the signal level of the cylinder identification pulse signals C1 and C2 and for making decision as to whether or not the cylinder identification pulse signals C1 and C2 are normal, and a back-up means for controlling the engine operation only on the basis of one of the cylinder identification pulse signals C1 and C2 when the other cylinder identification pulse signal is decided to be abnormal by the above-mentioned decision means. The decision means and the back-up means may be implemented software-wise.

Figure 2:
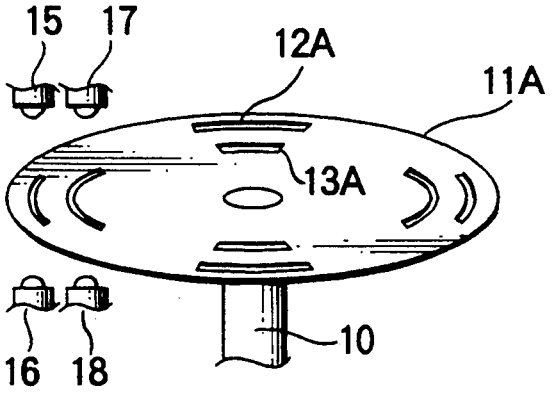
FIG. 2 is a schematic perspective view showing an exemplary structure of a cylinder identification signal generating means shown in FIG. 1.

FIG. 2 is a perspective view showing in concrete a combined structure of the cylinder identification pulse signal generating means 21 and 22. As can be seen in the figure, the cylinder identification pulse signal generating means 21 and 22 are implemented in an integral structure which includes a slit disk 11A mounted on a cam shaft 10 for rotation therewith and having radially and circumferentially offset slits generally denoted by 12A and 13A, and a pair of photo-detectors which are constituted by light emitting elements 15 and 17 and light receiving elements 16 and 18, respectively, and which are disposed in opposition to each other with the slit disk 11A interposed therebetween so that the slits 12A and 13A can optically be by the photo-detectors (15; 16) and (17; 18), respectively. Thus, it can be seen that an array of the radially outer slits 12A partakes in generation of one cylinder identification pulse signal C1 with the other array of the radially inner slits contributing to generation of the other cylinder identification pulse signal C2.

FIG. 3 is a timing chart showing pulse waveforms of the cylinder identification pulse signals C1 and C2 together with that of the reference position signal T' derived by logically ORing the signals C1 and C2. In this figure, T1 represents the first pulse width or duration corresponding to a time span between the reference positions B65° and B5° of the associated cylinder and P1 designates the first or leading pulse having the first pulse duration T1. Further, T2 represents the second pulse duration which is shorter than the first pulse duration T1, and P2 designates the second or trailing pulse which has the second pulse duration T2 and which usually plays no role in the determination of the reference position. As mentioned previously, the reference position signal T' is generated by logically ORing the cylinder identification pulse signals C1 and C2 by means of the OR circuit 36.

As can be appreciated from the foregoing, each of the cylinder identification pulse signals C1 and C2 is composed of pulse pairs including the first and second pulses P1 and P2, respectively. Further, the relation between the cylindrical identification signals C1 and C2 are set in such correlation that the first pulse duration T1 covers the second pulse duration T2. This can easily be realized by correspondingly sizing the slits 12A and 13A.

Figure 4:
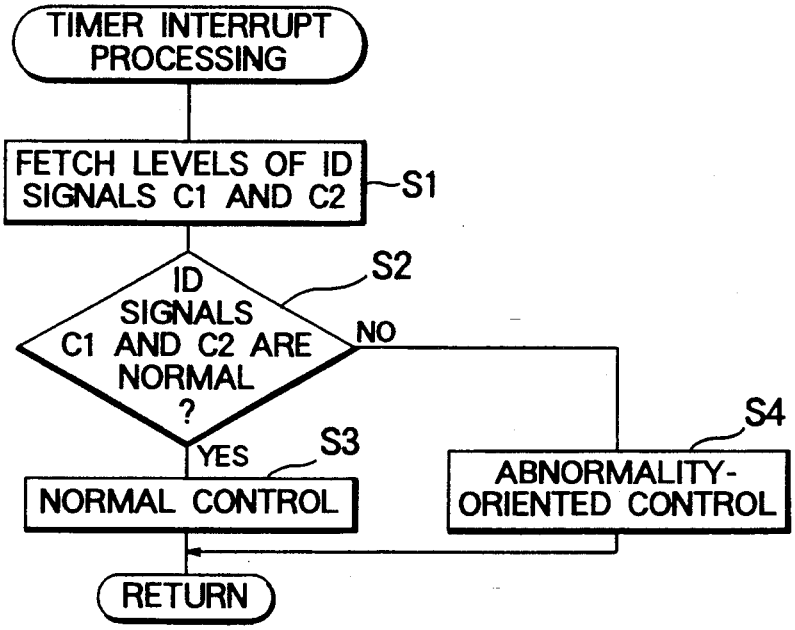
FIG. 4 is a flow chart for illustrating operation of the engine control apparatus according to the first embodiment of the invention.
Figure 5:
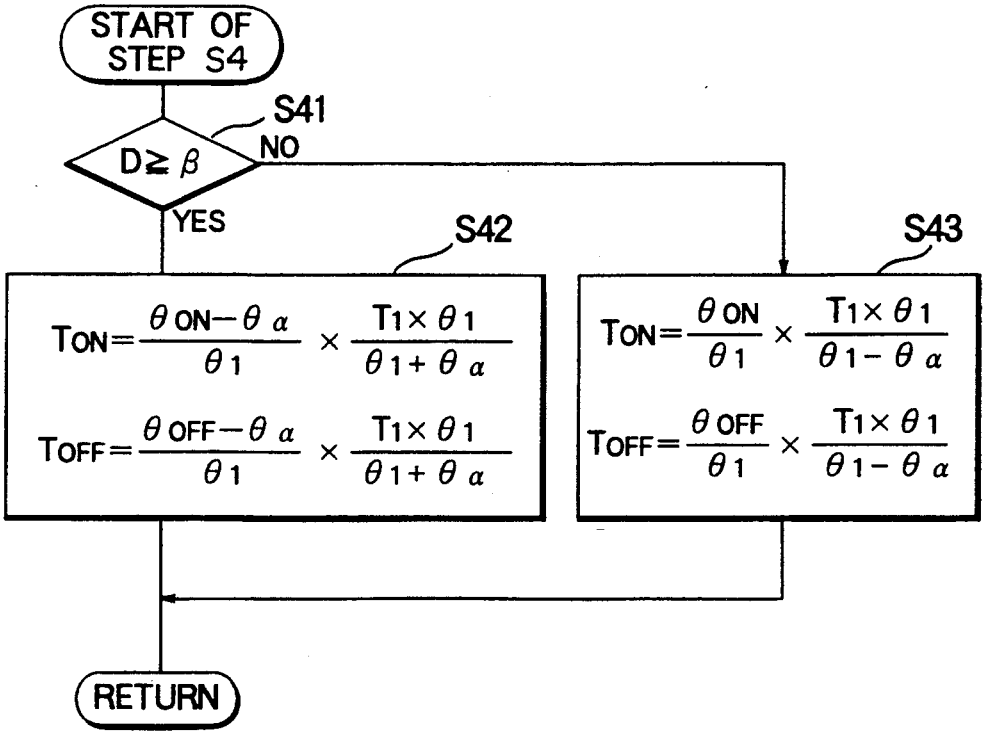
FIG. 5 is a flow chart for illustrating control operation performed upon occurrence of abnormality as detected in the procedure shown in FIG. 4.
Figure 6:
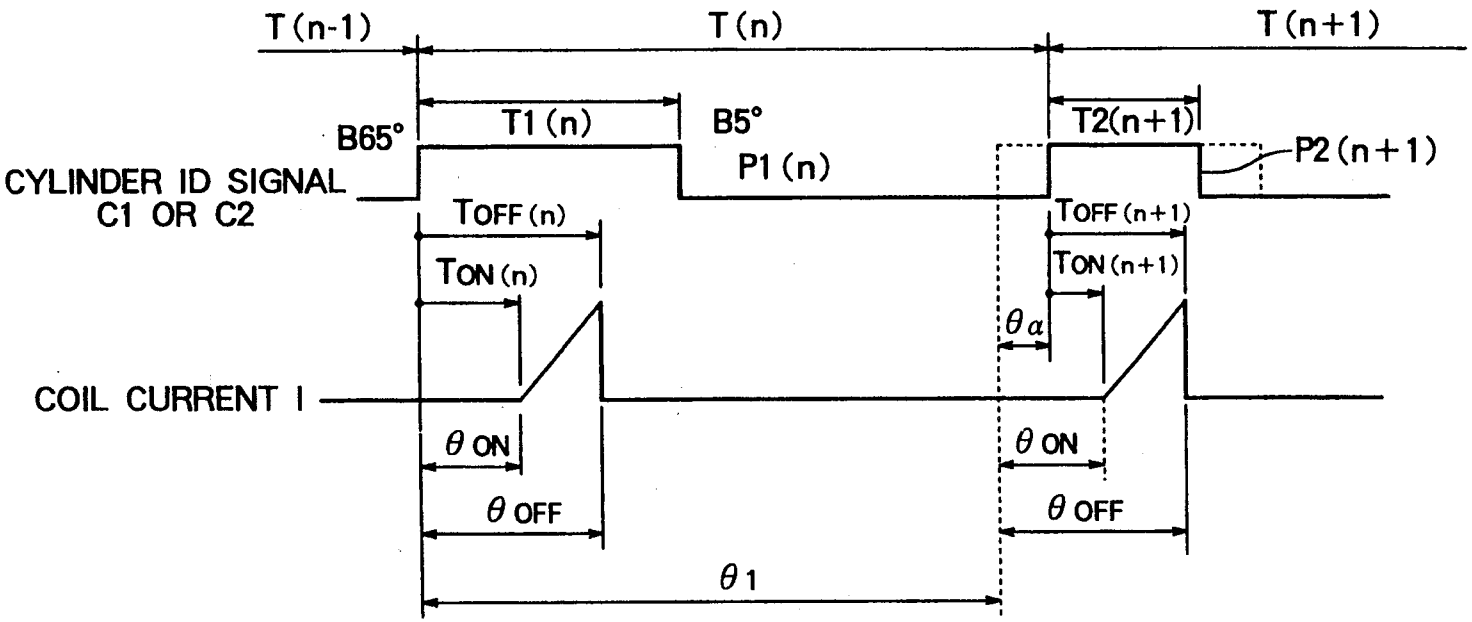
FIG. 6 is a diagram for illustrating control operation performed by the engine control apparatus according to the first embodiment upon occurrence of abnormality.

FIG. 4 shows a flow chart for illustrating operation of the timing control unit 33A, and FIG. 5 is a flow chart illustrating a routine included in the processing shown in FIG. 4 for performing engine control upon occurrence of abnormality in either one of the cylinder identification pulse signal channels (C1; C2). Further, FIG. 6 is a diagram for illustrating the ignition timing control operation which is performed upon occurrence of abnormality in either one of the cylinder identification pulse signal channels (C1; C2).

In FIG. 6, T(n) represents a current pulse period of the cylinder identification pulse signal C1 or C2 which is generated normally, T(n−1) represents a pulse period preceding to T(n), T(n+1) represents a succeeding pulse period, T1(n) represents the duration of the first pulse P1 in the current pulse period, T2(n+1) represents the duration of the succeeding second pulse P2, $\theta 1$ represents T(n) in terms of the crank angle relative to the reference position B65°, and $\theta\alpha$ represents an offset of the second pulse P2 relative to the first pulse P1 in terms of the crank angle. Further, $\theta_{ON}$ designates a crank angle from the leading edge of the pulse P1 at which the electrical energization of the ignition coil for the associated cylinder set is started, $\theta_{OFF}$ designates a crank angle at which the electrical energization of the associated ignition coil is stopped, i.e., the spark timing, $T_{ON}$ designates a timer controlled period preceding to the electrical energization of the ignition coils, and $T_{OFF}$ designates a timer controlled time point at which the electrical energization of the ignition coil is interrupted. It should be noted that the reference position B65° is selected as the reference for the timer-based ignition timing control operation.

Now, operation of the engine operation control apparatus according to the first embodiment of the invention shown in FIG. 1 will be described by reference to FIGS. 2 to 6.

Upon rotation of the engine, the cylinder identification pulse signal generating means 21 and 22 generate the cylinder identification pulse signals C1 and C2 of such waveforms as shown in FIG. 3, which signals C1 and C2 are inputted to the control means 3A via the input interface units 31A and 32A. As mentioned previously, each of the cylinder identification pulse signals C1 and C2 contains the pulse pairs each including the first pulse P1 corresponding to the reference position for the relevant cylinder and having a long pulse duration T1, and the second pulse P2 corresponding to the associated cylinder and having a shorter pulse duration T2. These cylinder identification pulse signals C1 and C2 are logically ORed by the OR gate 36, as a result of which the reference position signal T' containing pulses corresponding to the reference positions B65° and B5° for the individual cylinders is produced. As can be seen in FIG. 3, each pulse of the reference position signal T' has a rise-up edge or leading edge which temporally coincides with that of the first pulse P1 of the cylinder identification pulse signal. The reference position signal T' is inputted to the timing control unit 33A together with the cylinder identification pulse signals C1 and C2.

The timing control unit 33A is adapted or programmed to execute as an interruption routine the processing illustrated in FIG. 4 at every rise-up or leading edge of the reference position pulses T'.

More particularly, referring to FIG. 4, the timing control unit 33A fetches the signal levels of the cylinder identification pulse signals C1 and C2 and stores them in a memory (not shown) incorporated in the timing control unit 33A (step S1). In a step S2, the timing control unit 33A makes decision as to whether the cylinder identification pulse signals C1 and C2 are at normal level or not. When the cylinder identification pulse signals C2 and C2 are decided to be normal, the timing control unit 33A executes normally the ignition timing control procedure (step S3). On the other hand, in case it is decided in the step S2 that one of the cylinder identification pulse signal channels (C1; C2) suffers from abnormality, the timing control unit 33A executes a control program which is so prepared as to cope with such abnormality (step S4).

In the normal control step S3, the timing control unit 33A recognizes or identifies the individual cylinders and the reference positions thereof on the basis of the reference position signal T' as well as the cylinder identification pulse signals C1 and C2, calculates the ignition timing which conforms to the engine operation state and outputs the corresponding ignition timing control signals on the basis of the result of the calculation.

On the other hand, in the abnormality processing control step S4, the back-up means incorporated in the timing control unit 33A as mentioned previously executes processing steps illustrated in the flow chart of FIG. 5 to thereby output the ignition timing control signal on the basis of the normal one of the cylinder identification pulse signals C1 and C2. Referring to FIG. 5, the back-up means calculates the duty ratios of the pulses P1 and P2 in every pulse period and makes decision on the basis of the cylinder identification signal which is normal as to whether or not the duty ratio D is greater than or equal to a predetermined value $\beta$ in a step S41. In this conjunction, the reference value $\beta$ is so selected that the first pulse duration T1 and the second pulse duration T2 can be discriminatively identified from each other through comparison with the value $\beta$. More specifically, referring to FIG. 5, for the first pulse Pl(n) making appearance in the current pulse period, it is decided in the step S41 that $D \geqq \beta$, whereon the timing $T_{ON}$ for starting the electrical energization of the ignition coil and the timing $T_{OFF}$ for interrupting the electrical energization or conduction of the ignition coil are determined with reference to the second pulse P2(n+1) in the succeeding pulse period (step S42) on the basis of the cylinder identification signal which is normal. In this conjunction, the timings $T_{ON}$ and $T_{OFF}$ can be determined in accordance with the following expressions:

$$T_{ON}=\{(\theta_{ON}-\theta\alpha)/\theta 1\}\cdot\{T1\cdot\theta 1/(\theta 1+\theta\alpha)\}$$

$$T_{OFF}=\{(\theta_{OFF}-\theta\alpha)/\theta 1\}\cdot\{T1\cdot\theta 1/(\theta 1+\theta\alpha)\}$$

In the above expressions, $\theta_{ON}$ represents in terms of the crank angle a time from the leading edge of the cylinder identification pulse signal to the start of electrical energization of the ignition coil for the associated cylinder set, $\theta_{OFF}$ represents in terms of the crank angle a time intervening between the leading edge of the above-mentioned pulse and the interruption of electrical conduction of the ignition coil, $\theta_1$ represents in terms of the crank angle a period of the cylinder identification pulse signal and corresponds to T, and $\theta\alpha$ represents difference in duration between the first and second pulses P1 and P2 divided by two, as mentioned hereinbefore.

As can be seen from the above expressions and FIG. 6, the ignition timing control is performed with reference to the leading edge of the second pulse P2 with the ignition coil control period being shortened.

On the other hand, when the second pulse P2 makes appearance in the period for calculation, it is then decided in the step 41 that $D<\beta$, which is then followed by a step S43 where the ignition control timings $T_{ON}$ and $T_{OFF}$ are determined with reference to the first pulse P1 of the succeeding pulse period. In this case, the electrical energization start timing $T_{ON}$ and the cut-off timing $T_{OFF}$ can be determined in accordance with the following expressions.

$$T_{ON}=\{\theta_{ON}/\theta 1\}\cdot\{T1\cdot\theta 1/(\theta 1-\theta\alpha)\}$$

$$T_{OFF}=\{\theta_{OFF}/\theta 1\}\cdot\{T1\cdot\theta 1/(\theta 1-\theta\alpha)\}$$

As can be seen from the above expressions, the ignition coil turn-on/turn-off timings $T_{ON}$ and $T_{OFF}$ are determined with reference to the leading edge of the first pulse P1 with the ignition coil control timings being correspondingly extended, when compared with the first mentioned case.

In this manner, the ignition coil ON/OFF control signal can properly be generated for each of the cylinders #1 to #4 on the basis of only one cylinder identification pulse signal C1 or C2. Accordingly, even when a failure occurs in either one of the cylinder identification pulse signal generating channel 21 or 22, there can be realized the engine operation control with a high reliability, and thus safety can be ensured for the driver. Of course, in case both the cylinder identification pulse signal generating means 21 and 22 suffer simultaneously from abnormality, the back-up function described above is no more effective. However, possibility of such situation is negligibly low and thus can be put aside from the consideration in practical applications.

EMBODIMENT 2

Figure 7:
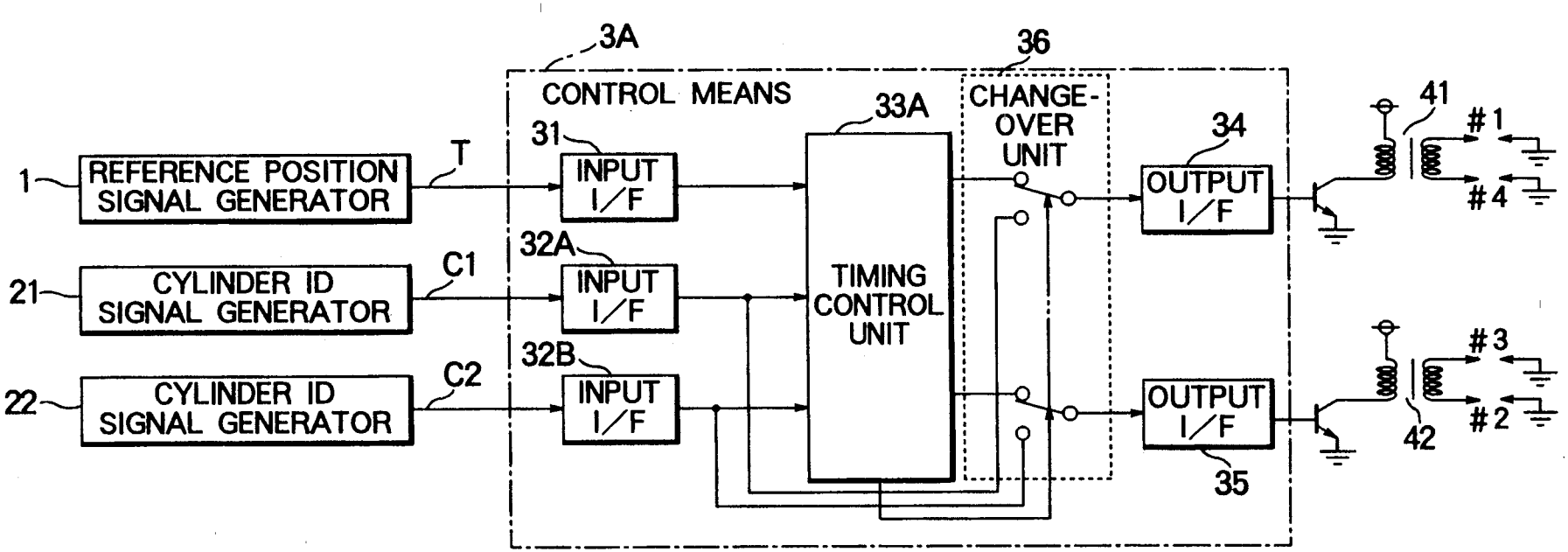
FIG. 7 is a block diagram showing a structure of an engine control apparatus according to a second embodiment of the present invention.

Next, description will be made of a second embodiment of the present invention. FIG. 7 shows in a schematic block diagram an arrangement of the engine control apparatus according to the second embodiment of the invention. In this figure, reference numerals 1, 41 and 42 denote same or equivalent components designated by same numerals in FIG. 12 and described hereinbefore in conjunction with the related art. Accordingly, repeated description of these components will be unnecessary. Further, a control means 3A, input interfaces 31A, 32A and 32B and a timing control unit 33A functionally correspond to those indicated by reference numerals 3, 31; 32 and 33, in FIG. 12.

In the case of the control apparatus according to the instant embodiment, there are provided a plurality of cylinder identification pulse signal generating means (two cylinder identification pulse signal generating means) 21 and 22 for Generating mutually different cylinder identification (ID) pulse signals C1 and C2 in synchronism with the rotation of an engine (not shown). The cylinder identification pulse signals C1 and C2 are inputted to the control means 3A via the input interface units 32A and 32B, respectively. Each of the cylinder identification pulse signals C1 and C2 contains a plurality of pulses which correspond mutually complementarily to the engine cylinders, respectively, wherein the plurality of the pulses have mutually different pulse widths or durations and bearing correspondence to the reference positions of the individual cylinders, respectively.

A change-over unit 36 is interposed between the output of the timing control unit 33A and the inputs of the output interface units 34 and 35. This change-over unit 36 cooperates with the timing control unit 33A to constitute a second back-up means for controlling the engine on the basis of the cylinder identification pulse signals C1 and C2 when the reference position signal T suffers from abnormality. More specifically, the change-over unit 36 is so implemented as to select the output of the timing control unit 33A (the position shown in FIG. 7) when the reference position signal T is normal, while selecting the cylinder identification pulse signals C1 and C2 when the reference position signal T is abnormal.

The timing control unit 33A according to the instant embodiment of the invention includes a first decision means for making decision as to whether the cylinder identification (ID) pulse signals C1 and C2 are normal, a first back-up means responsive to the decision of the first decision means that one of the cylinder identification pulse signals C1 and C2 is abnormal, for thereby controlling the engine on the basis of the reference position signal T and the other cylinder identification pulse signal which is normal, a second decision means for deciding whether or not the reference position signal T is normal, and switching means for generating a switching signal B to the change-over unit 36 when it is decided that the reference position signal is not normal. The switching means incorporated in the timing control unit 33A cooperates with the change-over unit 36 to constitute the second back-up means mentioned above.

Figure 8:
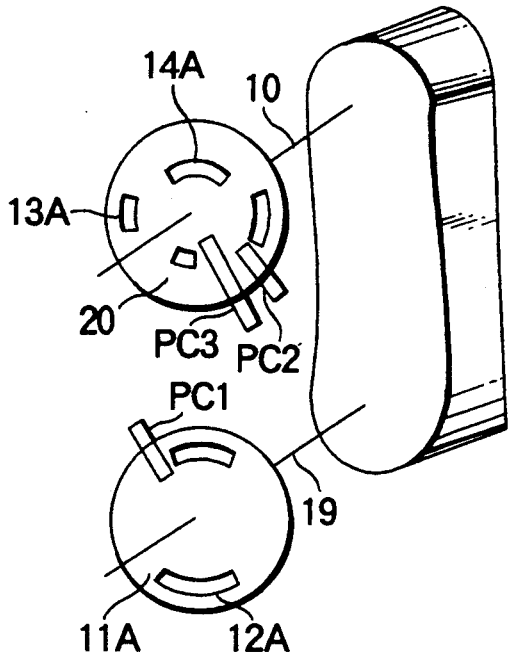
FIG. 8 is a schematic perspective view showing exemplary structures of a cylinder identification signal generating means and a reference position signal generation means shown in FIG. 7.

FIG. 8 is a perspective view showing schematically exemplary structures of the reference signal generating means 1 and the cylinder identification pulse signal generating means 21 and 22, respectively. As can be Seen in this figure, the cylinder identification pulse signal generating means 21 and 22 are implemented in an integral structure which includes a slit disk 20 mounted on a cam shaft 10 for rotation therewith and having radially and circumferentially offset slits generally denoted by 13A and 14A, and a pair of photo-detectors PC2 and PC3 which are disposed in opposition to the slits 13A and 14A for optically scanning the same. Thus, it can be seen that an array of the radially outer arcuate slits 13A partakes in generation of one cylinder identification pulse signal C1 with the other array of the radially inner arcuate slits 14A contributing to generation of the other cylinder identification pulse signal C2.

On the other hand, the reference position signal generating means 1 is constituted by a slit disk 11A having arcuate slits 12A extending circumferentially and mounted an a crank shaft 19 which rotates twice during a single rotation of the cam shaft 10, and a photo-detector 1 for detecting photoelectrically the slits 12*a*, whereby the reference position signal T (refer to FIG. 9) is generated.

Figure 9:
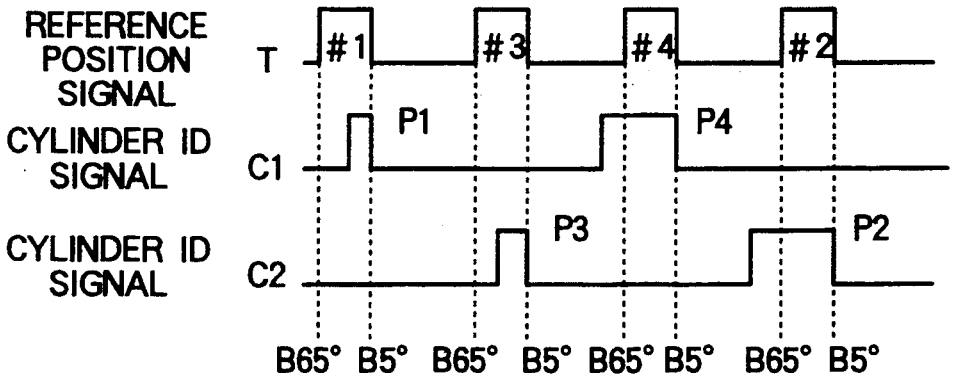
FIG. 9 is a waveform diagram showing waveforms of cylinder identification signals and a reference position signal generated and utilized in the engine control apparatus shown in FIG. 7.

FIG. 9 is a timing chart showing pulse waveforms of the cylinder identification pulse signals C1 and C2 together with that of the reference position signal T. As can be seen in the figure, the cylinder identification pulse signal C1 contains pulses P1 and P4 corresponding to the cylinders #1 and #4, respectively, while the cylinder identification pulse signal C2 contains pulses P3 and P2 which correspond to the cylinders #2 and #3, respectively, wherein the trailing or falling edges of the pulses P1 to P4 correspond to the respective reference positions B5° of the cylinders #1 to #4. It is further noted that each of the pulses P1 and P3 has a shorter pulse duration than that of the pulses P2 and P4 and that the pulses P1 and P4 as well as the pulses P3 and P2 have mutually different signal levels at the reference positions B65° of the respective cylinders. Thus, it can be said that the cylinder identification pulse signals C1 and C2 are composed of the pulses corresponding mutually complementarily to the individual cylinders and that each of these signal C1 and C2 consists of a combination of alternating pulses having short and long durations or widths, respectively.

Now, operation of the engine operation control apparatus according to the second embodiment of the invention shown in FIG. 7 will be described by reference to FIGS. 8 to 9.

Upon rotation of the engine, the reference position signal generating means 1 and the cylinder identification pulse signal generating means 21 and 22 generate the reference position signal T and the cylinder identification pulse signals C1 and C2 of such waveforms as shown in FIG. 9, which signals T, C1 and C2 are inputted to the timing control unit 33A of the control means 3A via the input interface units 31, 32A and 32B, respectively.

Figure 10:
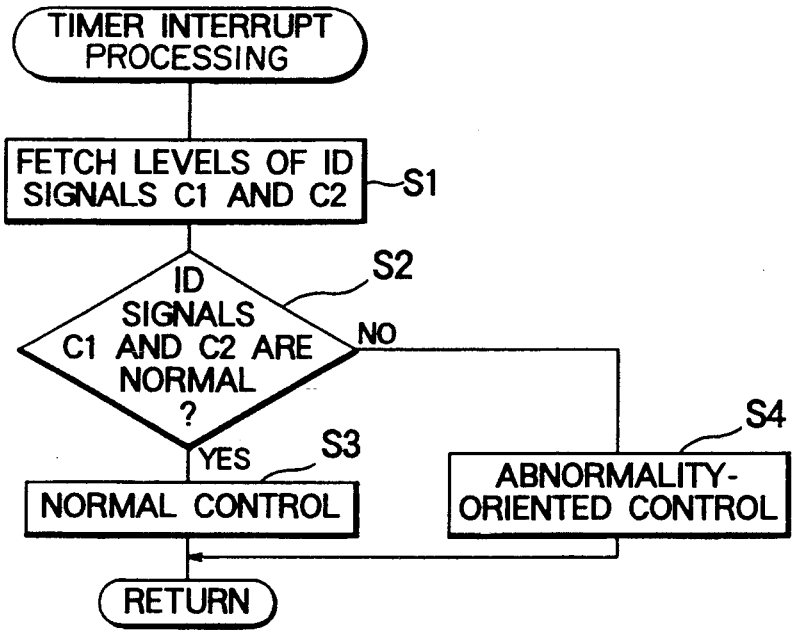
FIG. 10 is a flow chart for illustrating operation of the engine control apparatus according to the second embodiment of the invention.

The timing control unit 33A is adapted or programmed to execute as an interruption routine the processing illustrated in FIG. 10 in response to every rise-up or leading edge of the reference position pulses T.

More particularly, referring to FIG. 10, the timing control unit 33A fetches the signal levels of the cylinder identification pulse signals C1 and C2 and stores them in a memory (not shown) incorporated in the timing control unit 33A (step S1). In a step S2, decision is made as to whether the cylinder identification pulse signals C1 and C2 are normal or not (i.e., whether these signals contain the pulses in the predetermined sequences mentioned previously). When the cylinder identification pulse signals C2 and C2 are decided to be normal, the timing control unit 33A executes normally the ignition timing control procedure (step S3). On the other hand, in case it is decided in the step S2 that one of the cylinder identification pulse signals C1 or C2 suffers from abnormality, the timing control unit 33A executes a control program which is prepared so as to cope with such abnormality (step S4).

In the normal control step S3, the timing control unit 33A recognizes or identifies the individual cylinders and the reference positions thereof on the basis of the reference position signal T as well as the cylinder identification pulse signals C1 and C2, calculates the ignition timing which conforms to the prevailing engine operation state and outputs the corresponding ignition timing control signals on the basis of the result of the calculation.

On the other hand, in the abnormality-oriented control processing step S4, the first back-up means incorporated in the timing control unit 33A as mentioned previously outputs the ignition timing control signal on the basis of the reference position signal T and the normal one of the cylinder identification pulse signals C1 or C2. More specifically, the back-up means recognizes the cylinders and the reference position of the cylinder to be controlled currently on the basis of the reference position signal T and the normal one of the cylinder identification pulse signal C1 or C2 to thereby calculate the ignition timing in dependence on the engine operation state to thereby output the corresponding ignition timing control signal. The calculation as involved may be performed by resorting to the method described hereinbefore in conjunction with the first embodiment.

Parenthetically, in execution of the steps S3 and S4, the change-over unit 36 assumes the position shown in FIG. 7, whereby the ignition timing control signals are outputted from the timing control unit 33A through the output interfaces 33 and 34 to be supplied to the ignition coils 41 and 42, respectively.

In this manner, the ignition coil ON/OFF control signal can properly be generated for each of the cylinders #1 to #4 on the basis of the reference position signal T and one cylinder identification pulse signal C1 or C2. Accordingly, even when a failure occurs in either one of the cylinder identification pulse signal generating channel 21 or 22, there can be realized the engine operation control with a high reliability, and thus safety can be ensured for the driver.

Figure 11:
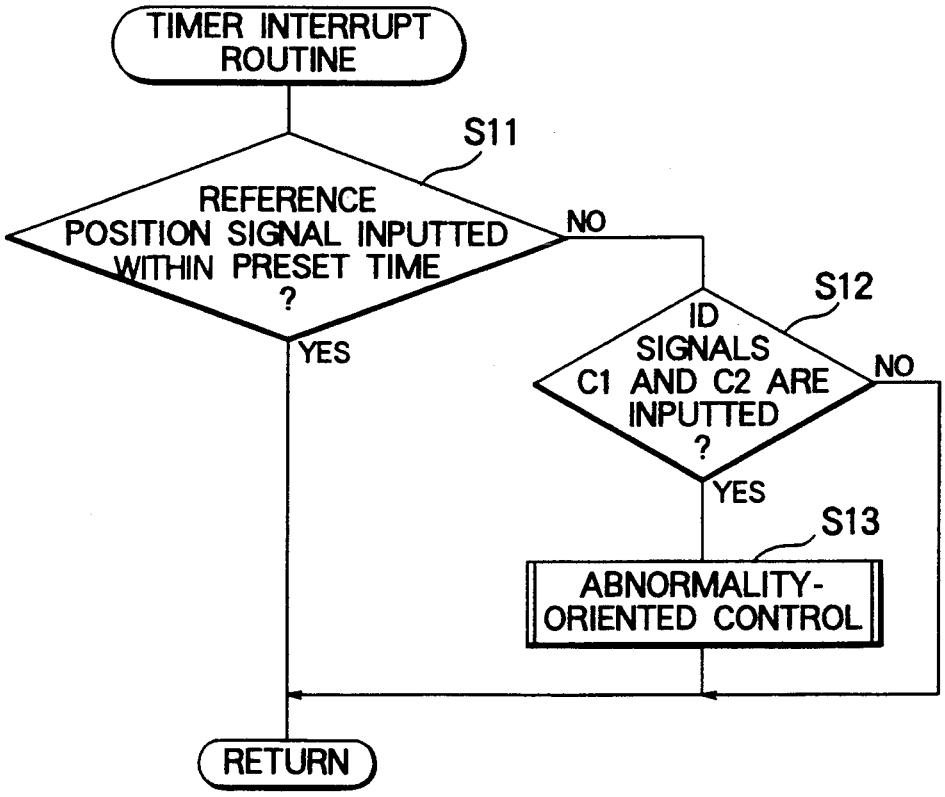
FIG. 11 is a flow chart for illustrating control operation performed upon occurrence of abnormality as detected in the procedure shown in FIG. 10.

The timing control unit 33A according to the second embodiment of the invention is designed to perform a timer-interrupt routine processing shown in FIG. 11 in parallel to execution of the processing described above by reference to FIG. 10.

Referring to FIG. 11, decision is made as to whether or not the reference position signal T is normal in dependence on whether or not the reference position signal pulse has been inputted within a predetermined time (step S11). If the answer of this decision step A11 is affirmative (YES), return is made to the processing shown in FIG. 10. On the other hand, when this decision step S11 results in "NO" (negative), the processing branches to a step S12 where it is decided whether or not the cylinder identification pulse signals C1 and C2 have been inputted. In case this decision step S12 results in "YES", the abnormality-oriented control processing is executed in a step S13. Namely, the second back-up means incorporated in the timing control unit 33A outputs the switching signal B to thereby switch the change-over unit 36 from the position shown in FIG. 7 to the position at which the cylinder identification pulse signals C1 and C2 are straightforwardly supplied to the output interface 34 and 35, respectively. In this case, the ignition coils 41 and 42 are driven in response to the pulses P1 to P4 contained in the cylinder identification pulse signals C1 and C2. At this juncture, it is noted that the duration of the electrical energization of the ignition coils 41 and 42 differ more or less. However, this provides practically no problem in controlling the engine operation because the timing at which the electrical energization of the ignition coil is interrupted or cut off coincides with the reference position B5°.

Parenthetically, it is to be mentioned that the pulses of the cylinder identification signals C1 and C2 are so set as to correspond to the groupwise ignition control, as described hereinbefore in conjunction with the first embodiment.

As can be appreciated from the above description, the ignition timing control can be performed even when the reference position signal T suffers from abnormality so far as the cylinder identification signals C1 and C2 remain normal. Of course, in case both the cylinder identification pulse signal generating means 21 or 22 suffer simultaneously from abnormality, the back-up function described above is no more effective. However, possibility of such situation is negligibly low and thus can be put aside from the consideration in practical applications.

Many features and advantages of the present invention are apparent form the detailed specification and thus it is intended by the appended claims to cover all such features and advantages of the apparatus which fall within the true spirit and scope of the invention. Further, since numerous modifications and changes will readily occur to those skilled in the art, it is not desired to limit the invention to the exact constructions and operations illustrated and described. By way of example, it has been described in conjunction with the first embodiment of the invention that the cylinder identification signal generating channels (21; 22) are so implemented that the first and second pulses P1 and P2 are generated alternately with each other for the purpose of groupwise ignition timing control of the four cylinders. However, it goes without saying that the ignition timing control can be performed for the individual cylinders independently by correspondingly arranging generation of the first and second pulses and other pulses, if required, in appropriate temporal sequence. The same also applies valid to the second embodiment. Further, the invention has been described in conjunction with the control of the four-cylinder engine. However, the teachings of the invention may be adopted in the control of a multi-cylinder engine in more general sense. Besides, it should be mentioned that the concept of the invention may equally be applied to the control of fuel injection instead of the ignition timing control, to substantially same effects. Furthermore, the cylinder identification signal generating means 21 and 22 and the reference signal generating means 1 in both the first and second embodiments described above may be realized in either structure shown in FIG. 2 or FIG. 8. Moreover, the first and second embodiments may be combined in various forms. Accordingly, all suitable modifications and equivalents may be resorted to, falling within the scope of the invention.

I claim:

1. A control apparatus for controlling operation of an internal combustion engine, comprising:

a plurality of individual cylinder identification signal generating means for generating cylinder identification signals each different from the other in synchronism with rotation of said engine; and control means for controlling said engine on the basis of said individual cylinder identification signals;

wherein each of said cylinder identification signals comprises a plurality of different types of pulses corresponding to each of said engine cylinders, respectively;

said plurality of different types of pulses including:

a first type pulse having a first pulse duration corresponding to a reference position for each of said cylinders; and a second type pulse having a second pulse duration shorter than said first pulse width and bearing no relation to said reference position;

wherein said control means includes:

an internal reference position signal generating means for generating a reference position signal corresponding to said reference position on the basis of a logical product of said individual cylinder identification signals;

determining means for determining whether said individual cylinder identification signals are within normal expected criteria; and back-up means for controlling said engine on the basis of other cylinder identification signal(s) when one of said cylinder identification signals is determined to be abnormal.

2. An engine control apparatus according to claim 1, wherein cylinders of said engine are grouped into a plurality of cylinders sets for group control thereof, said cylinder identification signal including a number of different types of pulses which corresponding to the number of said cylinder sets.

3. An engine control apparatus according to claim 1, wherein said engine includes four cylinders, and wherein said plurality of cylinder identification signal generating means includes a slotted disk mounted rotatably in synchronism with rotation of said engine, a first array of arcuate slots formed in said disk so as to extend circumferentially and having alternately differing lengths which correspond to said first and second pulse durations, respectively, a second circumferential array of arcuate slots formed in said disk in parallel with the slots of said first array and having alternately differing lengths which correspond to said second and first pulse duration, respectively, and a pair of photo-detecting means for detecting said first and second slots to thereby generate said first and second pulses.

4. An engine control apparatus according to claim 1, wherein said control means controls ignition timings for said cylinders.

5. An engine control apparatus according to claim 1, wherein said control means controls fuel supplies to said cylinders.

6. A control apparatus for controlling operation of an internal combustion engine, comprising:

reference position signal generating means for generating a reference position signal indicating reference positions of individual cylinders of said engine in synchronism with rotation of said engine;

a plurality of cylinder identification signal generating means for generating a plurality of cylinder identification signals each different from the other in synchronism with rotation of said engine; and control means for controlling said engine on the basis of said reference position signal and said cylinder identification signals;

wherein each of said cylinder identification signals includes a plurality of mutually complementary pulses corresponding to said individual cylinders, respectively;

said plurality of pulses comprising pulses having different pulse widths corresponding to said reference positions; and wherein said control means includes:

first determining means for determining whether each of said cylinder identification signals is within normal expected criteria;

first back-up means responsive to an output of said first determining means indicating that one of said cylinder identification signals is abnormal, to thereby control operation of said engine on the basis of the other cylinder identification signal and said reference position signal;

second determining means for determining whether said reference signal is normal; and second back-up means responsive to an output of said second determining means indicating that said reference position signal is abnormal, to thereby control operation of said engine on the basis of said cylinder identification signals.

7. An engine control apparatus according to claim 6, wherein said second back-up means comprises a change-over unit which normally assumes a position connected to the output side of said control means, said change-over unit being switched to a position connected to the outputs of said cylinder identification signal generating means when a determination is made by said second determining means that said reference signal is abnormal, to thereby allow said cylinder identification signals to be used as the control signals.

8. An engine control apparatus according to claim 6, wherein said reference position signal generating means includes a slotted disk mounted rotatably in synchronism with rotation of said engine and having a number of slots formed circumferentially corresponding to the cylinders of said engine, and photo-detector means for detecting said slots.

9. An engine control apparatus according to claim 6, wherein said plurality of cylinder identification signal generating means includes a slotted disk mounted rotatably in synchronism with rotation of said engine, a number of coaxial arrays of arcuate slots formed in said disk so as to extend circumferentially and having alternately differing lengths, said number corresponding to said cylinders, and a corresponding number of photo-detecting means for detecting said slot arrays to thereby generate said plurality of cylinder identification signals.

10. An engine control apparatus according to claim 6, wherein cylinders of said engine are grouped into a plurality of cylinder sets for group control thereof, the number of said cylinder identification signals corresponding to the number of said cylinder sets.

11. An engine control apparatus according to claim 6, wherein said control means controls ignition timings for said cylinders.

12. An engine control apparatus according to claim 6, wherein said control means controls fuel supplies to said cylinders.

* * * * *